US006307310B1

(12) United States Patent
Maehara et al.

(10) Patent No.: US 6,307,310 B1
(45) Date of Patent: Oct. 23, 2001

(54) COLOR CATHODE-RAY TUBE

(75) Inventors: Mutsumi Maehara; Tsuyoshi Iwata; Hiroshi Yoshioka, all of Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/254,976

(22) PCT Filed: Sep. 17, 1996

(86) PCT No.: PCT/JP96/02656

§ 371 Date: Mar. 17, 1999

§ 102(e) Date: Mar. 17, 1999

(87) PCT Pub. No.: WO98/12729

PCT Pub. Date: Mar. 26, 1998

(51) Int. Cl.[7] ..... H01J 29/80
(52) U.S. Cl. ..... 313/407; 313/402
(58) Field of Search ..... 313/402, 403, 313/404, 405, 406, 407, 408

(56) References Cited

U.S. PATENT DOCUMENTS

| | | | |
|---|---|---|---|
| 3,772,555 | | 11/1973 | McKee et al. . |
| 4,056,755 | | 11/1977 | Sohn . |
| 4,286,189 | | 8/1981 | Koizumi et al. . |
| 4,308,485 | | 12/1981 | Ignazio . |
| 4,645,968 | | 2/1987 | Ragland, Jr. . |
| 4,748,371 | * | 5/1988 | Bauder ..... 313/407 |
| 5,315,208 | | 5/1994 | van der Bolt et al. . |
| 5,804,912 | * | 9/1998 | Park ..... 313/407 |
| 6,104,132 | * | 8/2000 | Nose et al. ..... 313/407 |

FOREIGN PATENT DOCUMENTS

| | | |
|---|---|---|
| 60-40942 | 3/1985 | (JP) . |
| 60-162359 | 10/1985 | (JP) . |
| 62-71150 | 4/1987 | (JP) . |
| 62-170127 | 7/1987 | (JP) . |
| 62-223949 | 10/1987 | (JP) . |
| 63-250039 | 10/1988 | (JP) . |
| 5-114367 | 5/1993 | (JP) . |
| 7-220645 | 8/1995 | (JP) . |
| 8-64146 | 3/1996 | (JP) . |

* cited by examiner

*Primary Examiner*—Nimeshkumar D. Patel
*Assistant Examiner*—Todd Reed Hopper
(74) *Attorney, Agent, or Firm*—Antonelli, Terry, Stout & Kraus, LLP

(57) ABSTRACT

A color cathode ray tube comprising a perforated molded mask curved inward in the middle between its two opposite sides and having round corners, and a support frame curved outward in the middle between its two opposite sides and having round corners, wherein the corners of mask are respectively brought into contact with the corners of the mask and the frame. Therefore, the alignment accuracy between a shadow mask assembly and phosphor film and the magnetic shielding of the color cathode ray tube can be improved.

9 Claims, 4 Drawing Sheets

COLOR CATHODE-RAY TUBE

BACKGROUND OF THE INVENTION

1. Field of the Invention

The present invention relates generally to color cathode ray tubes for use with color display devices in color television sets and computer monitors or the like, and more particularly to those color cathode ray tubes with improvements in shape of a shadow mask assembly used therein 2. Description of the Related Art As shown in FIG. 1, a color cathode ray tube is configured including a glass valve comprising a panel portion 1 and a neck portion 2 as well as a funnel portion 3, a phosphorus-coated surface or fluorescent film 4 as formed on the inner surface of the panel portion 1, a shadow mask assembly 5 disposed at a specified location opposing and adjacent to the phosphor film, an internal magnetic shield (not shown) as formed into a shape along the inner wall of the funnel portion, and an electron gun 12 for production of three electron beams 13 toward the phosphor film 4. There are co-provided and disposed outside of the neck portion 2 a magnet 9 for purity adjustment and a center beam static convergence adjustment magnet 10 plus a side beam static convergence adjustment magnet 11, wherein said electron beams 13 operate exhibiting deflection in the presence of a magnetic field that is created by a deflection yoke 8 as disposed outside of the glass valve to thereby penetrate the perforated molded mask 6 letting the specified phosphor film 4 emit light.

In the color cathode ray tube, whether the accuracy of positional alignment of the shadow mask assembly 5 and the phosphor film 4 is good or bad can directly affect whether resultant display images are good or not in quality. More specifically, display images are deteriorated when deformation or the like takes place due to mechanical distortion and/or thermal distortion at the perforated molded mask 6 and the support frame 7 constituting the shadow mask assembly 5.

FIGS. 2 to 4 show one example of the shadow mask assembly of conventional color cathode ray tube. In FIG. 2 the reference numeral 40 designates such shadow mask assembly, 41 denotes a perforated molded mask, 44 represents a support frame, 45 indicates a frame-shaped portion, 46 shows a spring, and 47 is a projection (referred to as the "dowel" hereinafter) as formed at the frame-shaped portion. The perforated molded mask 41 comprises a curved surface portion 42 which has multiple electron beam penetration holes (not shown), and a skirt portion 43 that down goes from four peripheries of the curved surface portion 4, wherein the support frame 44 is structured from a rectangular frame-shaped portion 45 and springs 46 attached to the outer wall of the frame-shaped portion 45 for permitting attachment of the support frame 44 to inside of the panel portion (not shown) as well as a plurality of dowels 47 attached to the inner wall of the frame-shaped portion 45 for causing the inner wall of the frame-shaped portion 45 and the skirt portion 43 to come into contact engagement with each other.

FIG. 3 is a diagram showing a cross-sectional view at a location indicated by A–A' in FIG. 2. FIG. 4 is a sectional diagram at a location represented by B–B' in FIG. 2. The support frame 44 is of a nearly rectangle shape with nearby portions of four vertexes of such rectangle being connected by curved planes, which may resemble in shape substantially the L-shaped cross-section with the thickness t as shown in FIG. 3 and FIG. 4.

The prior art shadow mask assembly 40 has the dowels 47 that are formed on the side wall of the frame-shaped portion 45 of the support frame 44 and extend toward inside of said substantial rectangle. Here, the height h of the dowels 47 as measured from inside of the sidewall of the frame-shaped portion 45 will be called the "embossing amount". As shown in FIG. 3 and FIG. 4, the support frame 44 is of the shape which has those embossing portions of length values $\mathbf{1}_1$, $\mathbf{1}_2$ in the inside direction thereof. While lengthening these embossing portion lengths $\mathbf{1}_1$, $\mathbf{1}_2$ may enhance the mechanical strength of the support frame 44, an excessive increase in length is not achievable due to limitations received from the cathode ray tubes effective screen size.

Since said prior art shadow mask assembly 40 is formed when press-machining the perforated molded mask 41 as was shown in FIG. 2 in such a manner that respective upper edges (peripheries of the curved surface section 42) of the skirt portion 43 are slightly curved outwardly at the center portions as compared to the corner sections thereof, the clearance with respect to a contact plane between the skit portion 43 and the frame-shaped portion 45 becomes larger at the corners of the skirt portion 43 thereby necessitating additional provision of the dowels 47 at respective corners of the frame-shaped portion 45 while at the same time suffering from a problem in that the resulting perforated area of the curved surface portion 42 with respect to the size of the support frame 44 gets narrower to the extent corresponding to an increase in clearance.

In said prior art shadow mask assembly 40 the contact surfaces between the skirt portion 43 and the frame-shaped portion 45 become only those layout portions of the dowels at the corners thus limiting the substantial contact regions between the skirt portion and the frame-shaped portion, which leads to a problem that the magnetic resistivity, which is important among magnetic shield characteristics of color cathode ray tubes, is significant disadvantageously at said corners of the perforated molded mask 41 thus letting any effective magnetic shield characteristics be hardly obtainable.

Another problem faced with said prior art shadow mask assembly 40 is that since the skirt portion 43 is designed so that respective upper edges thereof (peripheries of the curved surface portion 42) are formed to be slightly curved outwardly at the center portion as compared to corners, the workability remains inferior when inserting for assembly the perforated molded mask 41 into the support frame 44 while simultaneously associating with the risk of deformation of the perforated molded mask 41 during assembly processes.

An object of the present invention is to provide a color cathode ray tube with a shadow mask assembly offering increased robustness against deformation due to mechanical and/or thermal distortion, which structure is high in accuracy of positional alignment with an associative fluorescent or phosphor film and also excellent in magnetic shield characteristics.

SUMMARY OF THE INVENTION

The present invention has attained said object by arranging the shadow mask assembly for use with the color cathode ray tube in a way which follows.

The shadow mask assembly used in the color cathode ray tube of the present invention is of the inward projected shape with substantially central portions of two side lines which nearly oppose each other at a skirt portion of a perforated molded mask being curved inwardly and with four corner sections of the perforated molded mask each being outwardly curved thus resembling approximately an arc-like shape of a radius R, while substantially central portions of two opposite side lines of a support frame are each curved outwardly to have an outward projected shape with four corners of the support frame each having a substantially arc-like shape of the radius R due to outward curvature and with a dowel being substantially centrally formed on each side line of the support frame. The distal end of such dowel is placed inside of a rectangle as formed by straight lines which connects together those points at which the corners of said perforated molded mask are in contact engagement with the support frame.

The shadow mask assembly used in the color cathode ray tube of the present invention is such that the corners of said support frame and the corners of said perforated molded mask are contacted together whereas the dowel of said support frame and the skirt portion of said perforated molded mask are in contact engagement with each other.

As the shadow mask assembly used in the color cathode ray tube of the present invention is of the outward projected shape with nearly central portions of the two opposite sides of the support frame being curved outwardly, it hardly receives any limitations of the embossing amount due to the effective screen size of the cathode ray tube thus making it possible to lengthen the embossing amount of the support frame while at the same time enabling enlargement of the inward embossing amount h of the dowel as formed substantially centrally on the side of the support frame, which in turn makes it possible to increase the strength of the support frame.

The shadow mask assembly used in the color cathode ray tube of the present invention decreases in magnetic resistivity rendering excellent the resulting shield characteristics because of the fact that the skirt portion of the perforated molded mask and the support fame are in contact engagement with each other at four corners thereof over a wide area.

The shadow mask assembly used in the color cathode ray tube of the present invention is such that since the distal end of the dowel is placed inside of the straight fine which connects together those points whereat the corners of the perforated molded mask and the support frame are in contact with each other, the distal end of the dowel and the skirt portion of the perforated molded mask are close in position to each other to thereby reduce distortion occurring at the perforated molded mask when bringing the skirt portion into contact with the dowel.

BRIEF DESCRIPTION OF THE INVENTION

DETAILED DESCRIPTION OF THE PREFERRED EMBODIMENT

A detailed explanation will now be given of the present invention based on some preferred embodiments thereof.

(Embodiment 1)

Figure 1:
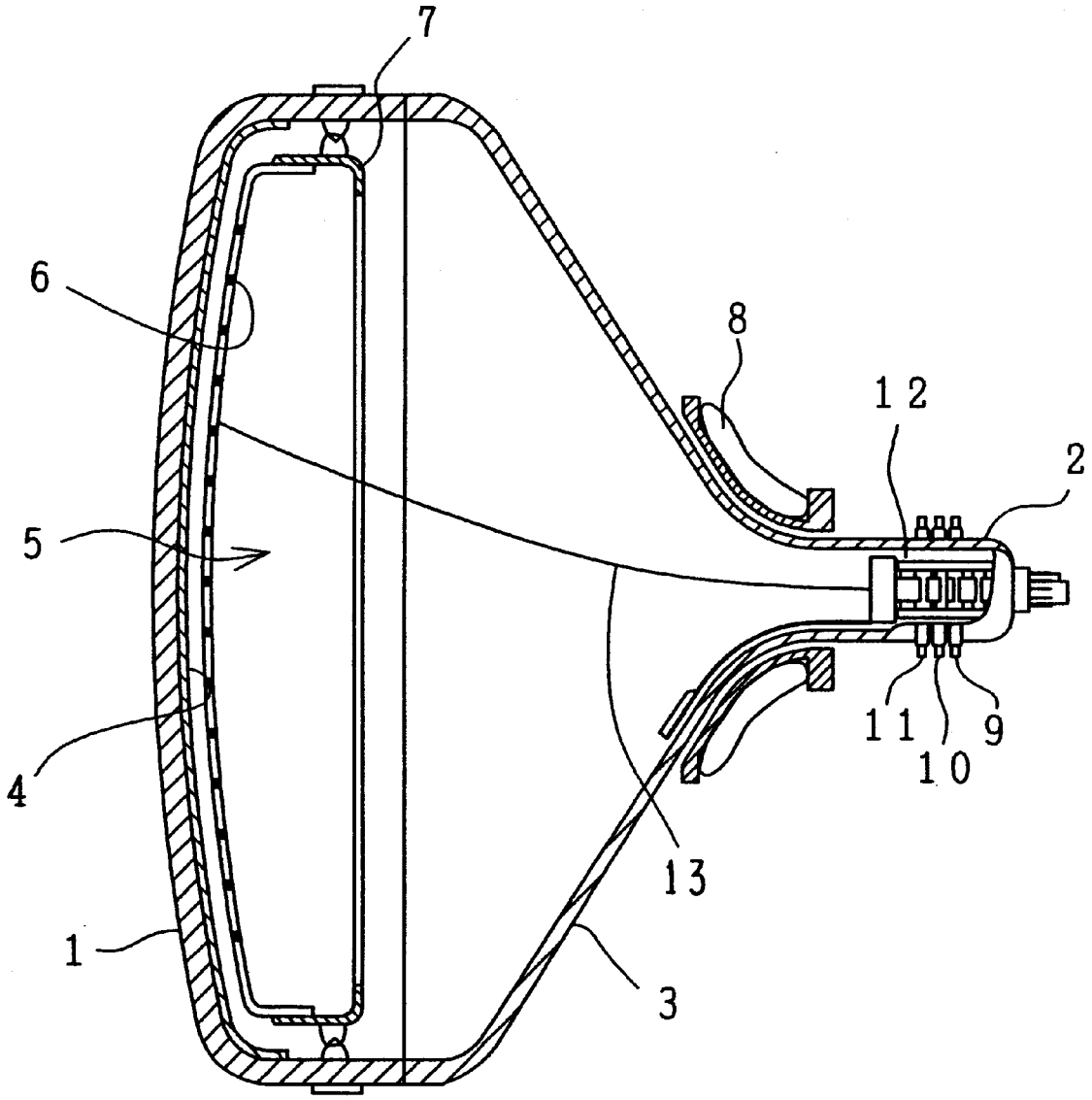
FIG. 1 PRIOR ART
FIG. 1 is a diagram for explanation of an overview of the structure of a color cathode ray tube in the prior art.
Figure 2:
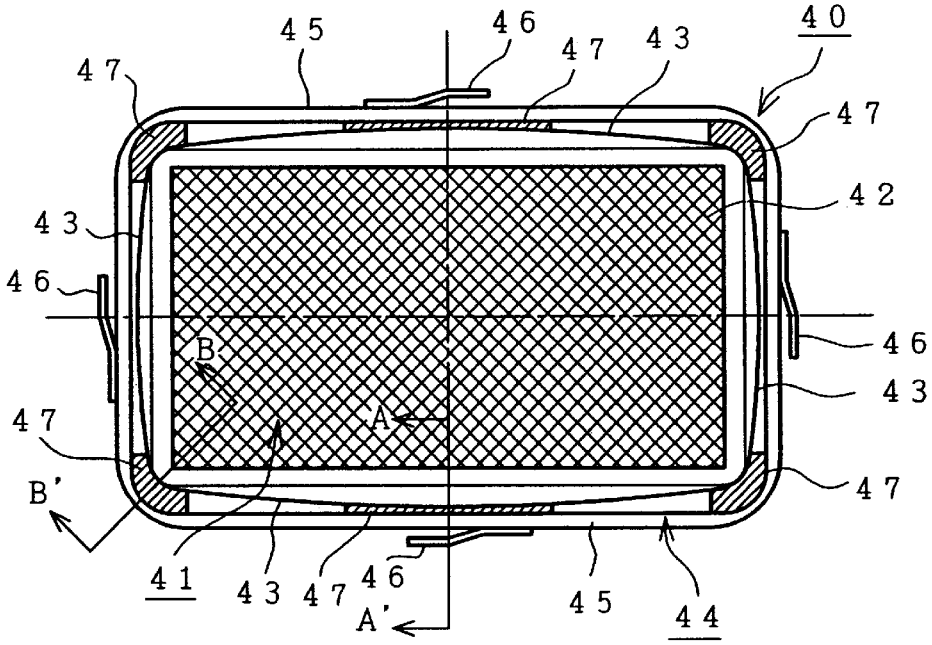
FIG. 2 PRIOR ART
FIG. 2 is a diagram for explanation of a configuration of a shadow mask assembly of the prior art color cathode ray tube.
Figure 3:
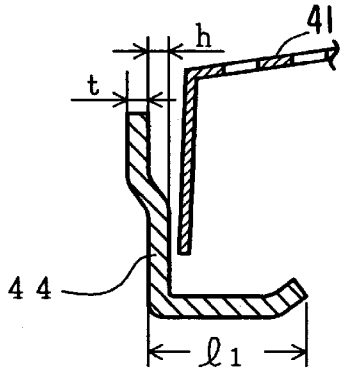
FIG. 3 PRIOR ART
FIG. 3 is a diagram showing a cross-sectional view of the shadow mask assembly of the prior art color cathode ray tube as taken along line A–A' in FIG. 2.
Figure 4:
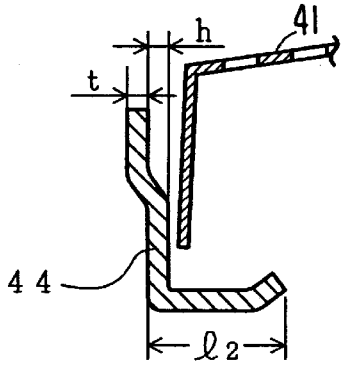
FIG. 4 PRIOR ART
FIG. 4 is a diagram showing a cross-sectional view of the shadow mask assembly of the prior art color cathode ray tube as taken along line B–B' of FIG. 2.
Figure 5:
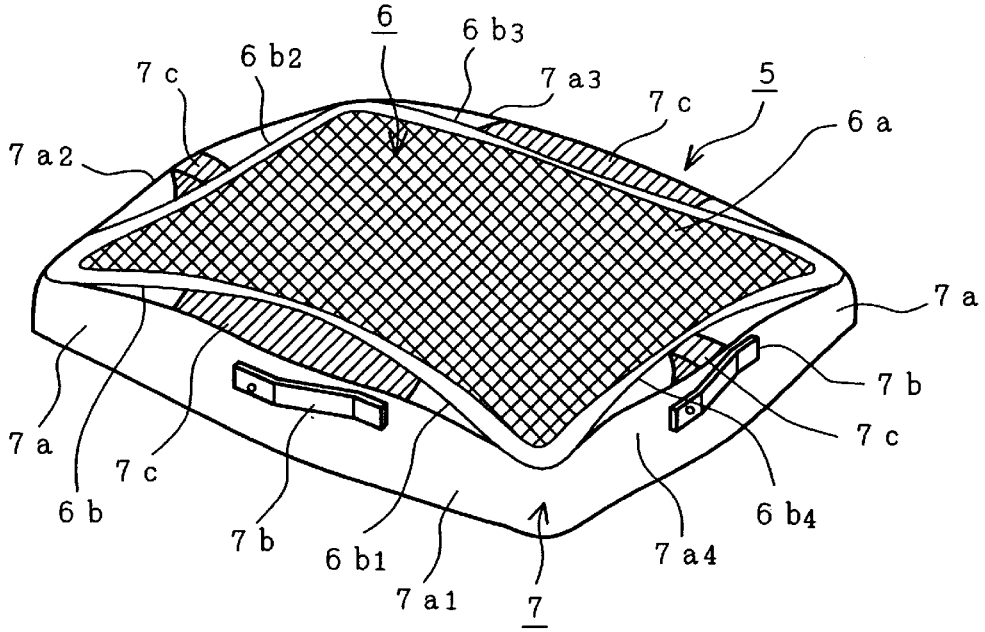
FIG. 5 is a diagram for explanation of an overview of the structure of a shadow mask assembly of a color cathode ray tube in accordance with one preferred embodiment of the present invention.

FIG. 5 is a diagram schematically depicting an overview of a shadow mask assembly of a color cathode ray tube in accordance with one preferred embodiment of the present invention. The shadow mask assembly 5 is equipped with a perforated molded mask 6 having a plurality of openings or holes therein, a support frame 7 for fixedly supporting this perforated molded mask 6, and springs 7*b* for use in securing the support frame 7 to inner side surfaces of the panel. In FIG. 5 the reference character 6*a* designates a curved surface portion of the perforated molded mask; 6*b* denotes a skirt portion of the perforated molded mask; $6b_1$, $6b_2$, $6b_3$, $6b_4$ indicate four side lines at the skirt portion 6*b*; 7*a* is a frame-shaped portion of the support frame 7; $7a_1$, $7a_2$, $7a_3$, $7a_4$ are four sides in the frame-shaped portion 7*a*; 7*b* is a spring; 7*c*, an abutting/locking protuberance member known as a dowel.

In FIG. 5 the perforated molded mask 6 is structured from the curved surface portion 6*a* having a great number of electron beam penetration holes (not shown) and the skirt portion 6*b* extends downwardly from the periphery of the curved surface portion 6*a*. The support frame 7 is composed of the frame-shaped portion 7*a* which is formed and disposed so as to have substantially a rectangular shape by the presence of four side lines $7a_1$, $7a_2$, $7a_3$, $7a_4$, and dowels 7*c* which are disposed inside of wall surfaces of the four sides $7a_1$, $7a_2$, $7a_3$, $7a_4$ of the frame-shaped portion 7*a*, respectively.

Figure 6:
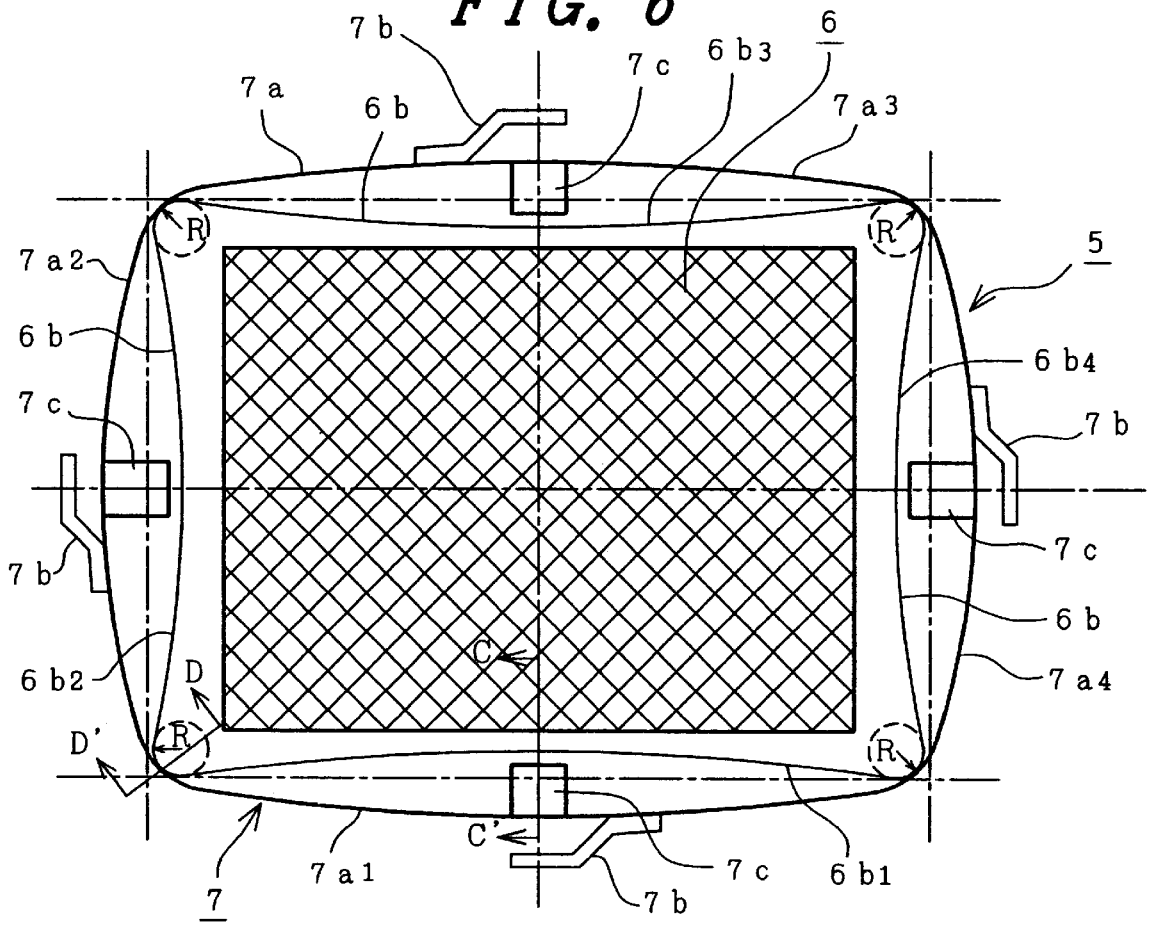
FIG. 6 is a diagram showing in plan view an arrangement of the shadow mask assembly of the color cathode ray tube in accordance with the embodiment of the present invention.

As shown in FIG. 6, the perforated molded mask 6 of the illustrative embodiment is machined, when forming the skirt portion 6*b* by press machining techniques, in a manner such that with regard to the skirt portion 6*b* of the four sides $6a_1$, $6a_2$, $6a_3$, $6a_4$, a respective one of the central or midway portions of these four sides is curved inwardly (in the center direction of the perforated molded mask 6) relative to the corner sections of the perforated molded mask 6. In addition, each corner of the perforated molded mask 6 is of substantially an arc-like shape of a radius R which is curved outwardly. The corners of the frame-shaped portion 7*a* are also formed into a nearly arc-like shape with radius R being curved outwardly in a manner similar to the corners of the perforated molded mask 6, while causing the corners of the perforated molded mask to be in internal contact therewith The four sides $7a_1$, $7a_2$, $7a_3$, $7a_4$ of the frame-shaped portion 7*a* are molded so that each central or "midway" portion is curved outwardly than the corners.

Figure 7:
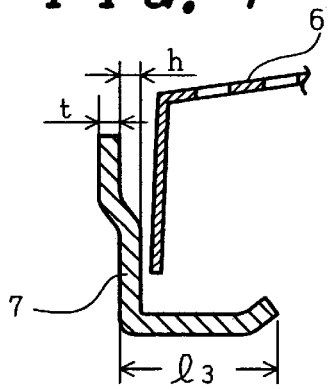
FIG. 7 is a diagram showing a sectional view of the shadow mask assembly of the color cathode ray tube in accordance with the embodiment of the present invention as taken along line C–C' of FIG. 6.
Figure 8:
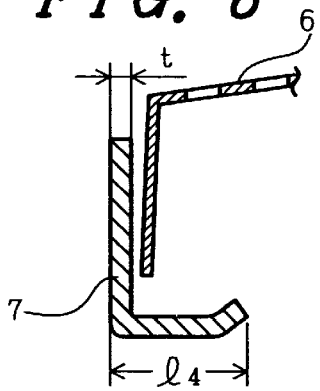
FIG. 8 is a diagram showing a sectional view of the shadow mask assembly of the color cathode ray tube in accordance with the embodiment of the present invention as taken along line D–D' in FIG. 6.

A cross-section of the midway portion (C–C' part in FIG. 6) of the frame-shaped portion 7*a* of the support frame 7 is illustrated in FIG. 7, while a cross-section of the corner (D–D' part in FIG. 6) of the frame-shaped portion 7*a* of the support frame 7 is depicted in FIG. 8. As shown in FIG. 7, the midway portion of the frame-shaped portion 7*a* has its thickness t and exhibits in general the L-shaped cross-section having an extension or "overhang" of the length $\mathbf{1}_3$ which extends inwardly while providing the dowel 7*c* of the convex shape that is projected inwardly. Additionally, although as shown in FIG. 8 the corner of the frame-shaped portion 7*a* also has the thickness t and exhibits the nearly L-shaped cross-section having an overhang of length 14 that extends inwardly, no dowels are provided at the corners in the embodiment shown herein.

Figure 9:
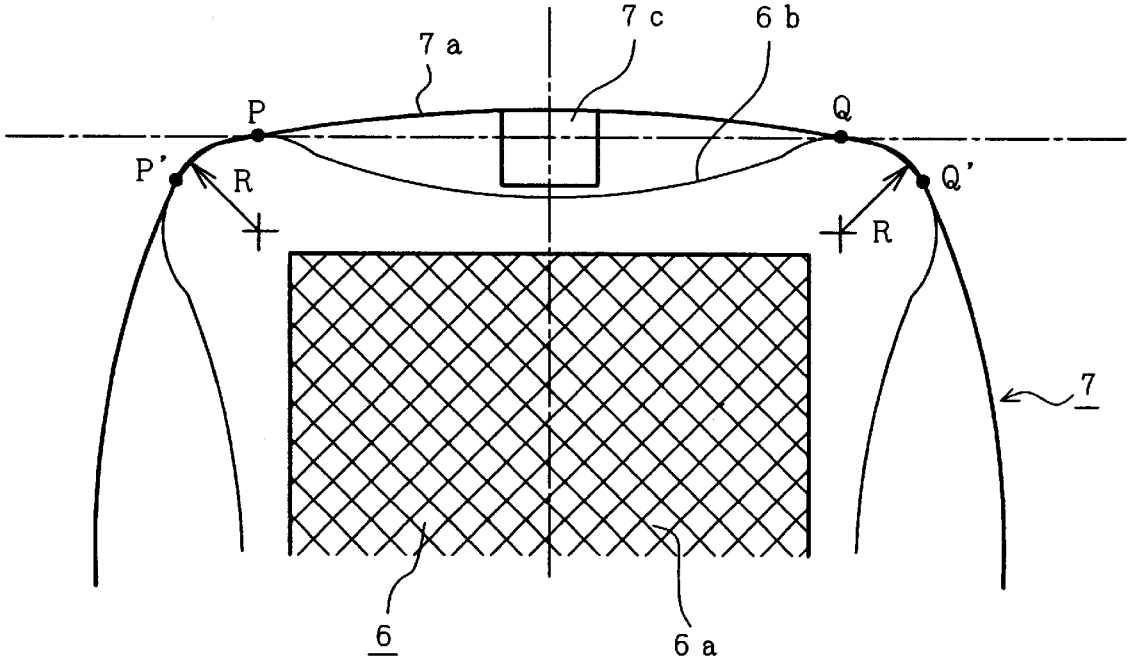
FIG. 9 is a plan view diagram for explanation of a positional relationship of a support frame and dowels as well as a molded mask employed in the shadow mask assembly of the color cathode ray tube in accordance with the embodiment of the present invention.

See FIG. 9, which shows details of a layout of the dowel 7*c* and the frame-shaped portion 7*a* of the support frame 7 as well as the perforated molded mask 6*b* of the illustrative embodiment. The frame-shaped portion 7*a* of the support frame 7 is of the shape with its almost center or midway portion curved outwardly. Any one of the corners of the perforated molded mask 6*b* and the corners of the frame-shaped portion 7*a* of the support frame 7 is of substantially the arc-like shape with the radius R. The corners of the perforated molded mask 6 and corresponding corners of the frame-shaped portion 7*a* are internally contacted together at portions P–P' and Q–Q' respectively. The dowel 7*c* is disposed at substantially the central or midway portion of the frame-shaped portion 7*a*, wherein its distal end is placed inside (in the center direction of the perforated molded mask 6) of a straight line that connects together specified points P, Q at which the corners of the frame-shaped portion 7*a* of the support frame 7 are in internal contact with the corners of the perforated molded mask 6. As the shadow mask assembly 5 of the subject embodiment is designed such that the distal end of the dowel is closer in position to the skirt portion of the perforated molded mask in the way stated above, any distortion remains less which can take place at the perforated molded mask during assembly through securing by soldering techniques or the like this skirt portion to the dowel. In addition, since the skirt portion of the perforated molded mask and the support frame are brought into contact with each other at four corners over a large area, the resultant magnetic resistivity decreases letting the magnetic shield characteristics be excellent.

As the shadow mask assembly of the embodiment of the present invention is arranged including the support frame with nearly midway portions of two opposite sides being curved outwardly into an outward projected shape, it becomes possible to increase the inward embossing amount of the dowel as formed substantially centrally on the side of the support frame. As a result of such arrangement, it was possible to increase the mechanical strength or robustness against twist of long and short sides of the support frame 7 as well as any possible thermal distortion.

(Embodiment 2)

This embodiment is similar to the embodiment 1 except that dowels are additionally provided at four corners of the support frame 7 of FIG. 6, which are secured by soldering techniques to the perforated molded mask 6. In this embodiment also, distortion stays less which can occur at the perforated molded mask when securing for assembly the skirt portion to the dowels by soldering or the like. Furthermore, as the skit portion of the perforated molded mask and the support frame are contacted together at four corners over a wide area, the resulting magnetic resistivity decreases letting the magnetic shield characteristics become excellent Simultaneously, it was possible to increase the strength of the shadow mask assembly 5 against mechanical and/or thermal distortion.

What is claimed is:

1. A color cathode ray tube comprising a glass valve with a panel portion and a funnel portion as well as a neck portion being integrated together, a phosphor film formed on the inner surface of said panel portion, an electron gun disposed at said neck portion for generation of an electron beam toward said phosphor film, a perforated molded mask disposed adjacent to said phosphor film and having a plurality of holes for allowing an electron beam to reach an individual predetermined position on said phosphor film, a support frame extended so as to surround outer peripheral edges of said perforated molded mask, and an internal magnetic shield having a side wall extending from said support frame along the funnel inner surface, wherein said molded mask has a substantially rectangular shape with long sides and short sides and with rounded corners, said short sides or long sides of said molded mask being inwardly curved with respect to the tube axis, and said support frame having a substantially rectangular shape with long sides and short sides, said long side or said short side of said support frame being outwardly curved with respect to the tube axis, and a dowel being provided at a central portion of said long sides or said short side of said support frame without a dowel being provided at a central portion of said long sides or said short sides of said molded mask.

2. A color cathode ray tube according to claim 1, wherein both said short sides and said long sides of said molded mask are inwardly curved with respect to the tube axis, and both said long sides and said short sides of said support frame are outwardly curved with respect to the tube axis.

3. A color cathode ray tube according to claim 2, wherein said dowel is provided at the central portion of both of said long sides and said short sides of said support frame.

4. A color cathode ray tube according to claim 1, wherein a dowel is further provided at a corner of said support frame.

5. A color cathode ray tube according to claim 1, wherein said molded mask and said support frame have contacts at the corners thereof which are connected by one of said long sides of said support frame, said dowel is provided at the central portion of said one of said long sides, the distal edge of said dowel is nearer to the tube axis than a line connecting said contacts.

6. A color cathode ray tube according to claim 1, wherein said molded mask and said support frame have contacts at the corners thereof connected by one of said short sides of said support frame, said dowel is provided at the central portion of said one of said short sides, the distal edge of said dowel is nearer to the tube axis than a line connecting said contacts.

7. A color cathode ray tube comprising a glass valve with a panel portion and a funnel portion as well as a neck portion being integrated together, a phosphor film formed on the inner surface of the panel portion, an electron gun disposed at said neck portion for generation of an electron beam toward the phosphor film, a perforated molded mask of substantially rectangular shape disposed adjacent to said phosphor film and having a plurality of holes for allowing an electron beam to reach an individual predetermined position on the phosphor film, a support frame of substantially rectangular shape extended so as to surround outer peripheral edges of the perforated molded mask, and an internal magnetic shield having a side wall extending from the support frame along the funnel inner surface, wherein said perforated molded mask is inwardly curved at substantially central portions of two opposite sides with corners each having a substantially arc-like shape being curved outwardly, said support frame being outwardly curved at substantially central portions of two opposite sides with corners each having a substantially arc-like shape being curved outwardly, the corners of said perforated molded mask being in internal contact with the corners of said support frame and a distal edge of a dowel provided on a side of said support frame is disposed at least partially inside a straight line connecting together predetermined points of the corners of said perforated molded mask which are in contact with the corners of said support frame.

8. A color cathode ray tube according to claim 7, wherein said dowel provided at said support frame is provided at substantially a central portion of said support frame.

9. A color cathode ray tube according to claim 7, wherein said dowel is further provided at least one corner of said support frame.

* * * * *